US008340537B2

(12) United States Patent
Bae et al.

(10) Patent No.: US 8,340,537 B2
(45) Date of Patent: Dec. 25, 2012

(54) IMAGE FORMING APPARATUS AND METHOD OF COMPENSATING FOR PRINTING QUALITY OF THE IMAGE FORMING APPARATUS

(75) Inventors: Hyo-joon Bae, Seoul (KR); Yun-su Kim, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 203 days.

(21) Appl. No.: 12/817,522

(22) Filed: Jun. 17, 2010

(65) Prior Publication Data

US 2011/0085809 A1 Apr. 14, 2011

(30) Foreign Application Priority Data

Oct. 9, 2009 (KR) ..... 10-2009-0096247

(51) Int. Cl.
*G03G 15/08* (2006.01)
*G03G 15/10* (2006.01)

(52) U.S. Cl. ..... 399/29; 399/60

(58) Field of Classification Search ..... 399/29, 399/60, 72

See application file for complete search history.

(56) References Cited

U.S. PATENT DOCUMENTS 6,597,878 B2 * 7/2003 Nakazato et al. ..... 399/49
7,269,362 B2 * 9/2007 Hama et al. ..... 399/27
7,787,782 B2 * 8/2010 Takada ..... 399/12

* cited by examiner

*Primary Examiner* — David Gray
*Assistant Examiner* — Gregory H Curran
(74) *Attorney, Agent, or Firm* — Stanzione & Kim, LLP

(57) ABSTRACT

A method of compensating for printing quality of an image forming apparatus includes determining a pattern to be printed as a first pattern which is a default pattern and a second pattern obtained by changing the first pattern according to a toner stress index that represents a deteriorated degree of remaining toner, and printing the determined pattern with the remaining toner.

31 Claims, 11 Drawing Sheets

301

| PRINTED PAGES PER 1 PRITNING JOB | | 1 | 2 | 3 | 5 | 10 |
|---|---|---|---|---|---|---|
| REVOLUTION RATE | | 48.33 | 28.22 | 21.51 | 16.15 | 12.12 |
| OD (Optical Density) | 600 PAGE | 1.13 | 1.09 | 1.12 | 1.07 | 1.04 |
| | 1200 PAGE | 1.1 | 1.09 | 1.07 | 1.11 | 1.13 |
| | 1800 PAGE | 1.07 | 1 | 1.13 | 1.06 | 1.1 |
| | 2400 PAGE | 0.99 | 1.05 | 1.01 | 1.07 | 0.97 |
| | 3000 PAGE | 1.04 | 1.06 | 1.02 | 1.03 | 1.02 |
| | 3600 PAGE | 0.99 | 0.92 | 0.97 | 1.09 | 1.07 |
| | 4200 PAGE | 0.94 | 1 | 0.97 | 1 | 1.02 |
| | 4800 PAGE | 0.95 | 0.94 | 0.93 | 0.98 | 0.98 |
| | 5400 PAGE | 0.87 | 0.92 | 0.93 | 0.97 | 0.94 |
| | 6000 PAGE | 0.85 | 0.93 | 0.94 | 0.89 | 0.95 |
| | AVERAGE | 0.99 | 1 | 1.01 | 1.03 | 1.02 |

401

| USE RATE | | 1 | 2 | 5 | 10 | 15 |
|---|---|---|---|---|---|---|
| OD (Optical Density) | 600 PAGE | 1.13 | 1.09 | 1.08 | 1.12 | 1.08 |
| | 1200 PAGE | 1.1 | 1.08 | 1.07 | 1.11 | 1.13 |
| | 1800 PAGE | 1.07 | 1 | 1.13 | 1.06 | 1.1 |
| | 2400 PAGE | 0.99 | 1.05 | 1.01 | 1.07 | 0.97 |
| | 3000 PAGE | 1.05 | 1.07 | 1.02 | 1.04 | 1.03 |
| | 3600 PAGE | 1 | 0.93 | 0.98 | 1.1 | 1.09 |
| | 4200 PAGE | 0.96 | 1.02 | 0.98 | 1.03 | 1.05 |
| | 4800 PAGE | 0.97 | 0.97 | 0.95 | 1.01 | 1.02 |
| | 5400 PAGE | 0.9 | 0.94 | 0.95 | 1.01 | 1 |
| | 6000 PAGE | 0.88 | 0.96 | 0.97 | 0.94 | 1.02 |
| | AVERAGE | 1.01 | 1.01 | 1.01 | 1.05 | 1.05 |

601

| | | EXPERIMENT 1 | | EXPERIMENT 2 | | EXPERIMENT 3 | |
|---|---|---|---|---|---|---|---|
| | | PR NTING TEST PATTERN | NOT PRINTING TEST PATTERN | PRINTING TEST PATTERN | NOT PRINTING TEST PATTERN | PRINTING TEST PATTERN | NOT PRINTING TEST PATTERN |
| OD (Optical Density) | 100 PAGE | 1.02 | 1.01 | 1.01 | 1.01 | 1.03 | 1.04 |
| | 200 PAGE | 0.99 | 0.99 | 1.04 | 1.01 | 1.01 | 1.02 |
| | 300 PAGE | 1.02 | 1.03 | 1.02 | 1.03 | 1 | 1.01 |
| | 400 PAGE | 1.03 | 1.03 | 1.03 | 1.02 | 0.98 | 1.01 |
| | 500 PAGE | 1.02 | 0.99 | 0.98 | 1.01 | 0.99 | 1 |
| | 600 PAGE | 1 | 0.98 | 0.99 | 0.98 | 0.99 | 0.99 |
| | 700 PAGE | 1.01 | 0.99 | 0.99 | 0.97 | 1 | 0.97 |
| | 800 PAGE | 0.99 | 0.96 | 0.98 | 0.98 | 1.01 | 0.96 |
| | 900 PAGE | 0.99 | 0.97 | 1 | 0.96 | 1 | 0.96 |
| | 1000 PAGE | 0.95 | 0.93 | 0.98 | 0.95 | 0.97 | 0.97 |

602

603

| TS_Index Level | TONER CONSUMPTION AMOUNT |
|---|---|
| 0~10 | Solid (114mm * 210mm) |
| 10~20 | Solid (114mm * 210mm * 2) |
| 20~30 | Solid (114mm * 210mm * 3) |
| 30~40 | Solid (114mm * 210mm * 4) |
| 40~50 | Solid (114mm * 210mm * 5) |
| 50~60 | Solid (114mm * 210mm * 6) |
| 60~70 | Solid (114mm * 210mm * 7) |
| 70~80 | Solid (114mm * 210mm * 8) |
| 80~90 | Solid (114mm * 210mm * 9) |
| 90~100 | Solid (114mm * 210mm * 10) |

IMAGE FORMING APPARATUS AND METHOD OF COMPENSATING FOR PRINTING QUALITY OF THE IMAGE FORMING APPARATUS

CROSS-REFERENCE TO RELATED APPLICATIONS

This application claims priority under 35 U.S.C. §119(a) from Korean Patent Application No. 10-2009-0096247, filed on Oct. 9, 2009, in the Korean Intellectual Property Office, the disclosure of which is incorporated herein in its entirety by reference.

BACKGROUND

1. Field of the Invention

The present general inventive concept relates to an image forming apparatus and a method of compensating for printing quality of the image forming apparatus.

2. Description of the Related Art

Image forming apparatuses are apparatuses for transferring image signals onto a printing medium that is a recording medium as a visible image according to a digital signal input from a computer or a scanner. Image forming apparatuses may include a laser beam printer for forming images by using electrostatic latent images. A color laser beam printer that forms color images may use toners of different colors, for example, yellow (Y), magenta (M), cyan (C), and black (K) colors. When a user of the color laser beam printer wants to print a color image, the color laser beam printer mixes the toners of different colors to print the color image. In particular, in order to provide the color image of high printing quality, unit images, each of which is formed by each of the colors, should overlap each other accurately.

SUMMARY

The present general inventive concept provides an image forming apparatus and a method of compensating for a printing quality of the image forming apparatus. However, the present general inventive concept is not limited to this technical subject.

Additional features and utilities of the present general inventive concept will be set forth in part in the description which follows and, in part, will be obvious from the description, or may be learned by practice of the general inventive concept.

According to exemplary embodiments of the present general inventive concept, there is provided a method of compensating for printing quality of an image forming apparatus which includes a plurality of developers to print color images, the method including calculating a toner stress index representing a deteriorated degree of a toner remaining in each of the plurality of developers, determining one of a first pattern which is a default pattern used in at least one of an auto color registration (ACR) operation and an image density (ID) control operation and a second pattern which is obtained by changing the first pattern according to the calculated toner stress index before performing the ACR operation and the ID control operation, when the second pattern is determined, determining a property of the second pattern according to the calculated toner stress index, and printing the determined pattern by using the remaining toner.

According to exemplary embodiments of the present general inventive concept, there is provided an image forming apparatus compensating for printing quality, the image forming apparatus including a developing unit including a plurality of developers to print color images, a calculator to calculate a toner stress index which represents a deteriorated degree of a toner remaining in each of the developers, a pattern determiner to determine one of a first pattern which is a default pattern used in at least one of an auto color registration (ACR) operation and an image density (ID) control operation and a second pattern which is obtained by changing the first pattern according to the calculated toner stress index before performing the ACR operation and the ID control operation, a property determiner to determine a property of the second pattern according to the calculated toner stress index when the second pattern is determined, a storage unit to store information including the calculated toner stress index and a toner consumption amount corresponding to the toner stress index, and a controller to control the image forming apparatus to print the determined pattern with the remaining toner.

Exemplary embodiments of the present general inventive concept may also provide method of compensating for printing quality of an image forming apparatus which includes a plurality of developers to print color images, the method including determining the amount of deterioration of toner in each of the plurality of developers with a processor of the image forming apparatus, determining the consumable amount of toner remaining according to the determined amount of deterioration of the toner with the processor, and when the determined consumable amount is greater than a toner amount to print a predetermined pattern, modifying the predetermined pattern with the processor so as to use the determined consumable amount of toner remaining in a print operation with the image forming apparatus.

The method may also include printing the modified pattern with an image forming unit of the image forming apparatus, detecting the printed modified pattern with a pattern detector in the image forming apparatus, and performing at least one of an auto color registration (ACR) and image density control on the detected modified pattern.

The method may also include when the determined consumable amount is less than a toner amount to print a predetermined pattern, printing the predetermined pattern with the image forming apparatus.

The method may also include detecting the printed modified pattern with a pattern detector in the image forming apparatus, and performing at least one of an auto color registration (ACR) and image density control on the detected modified pattern.

Exemplary embodiments of the present general inventive concept may also provide an image forming apparatus compensating for printing quality, the image forming apparatus including a plurality of developers, a processor to determine the amount of deterioration of toner in each of a plurality of developers and to determining the consumable amount of toner remaining according to the determined amount of deterioration of the toner with the processor, where when the determined consumable amount is greater than a toner amount to print a predetermined pattern, the processor modifies the predetermined pattern so as to use the determined consumable amount of toner remaining in a print operation with the image forming apparatus.

The image forming apparatus may also include a pattern detector to detect the modified pattern that is printed by the image forming apparatus, where the processor performs at least one of an auto color registration (ACR) and image density control on the detected modified pattern.

The image forming apparatus may also include that when the determined consumable amount is less than a toner amount to print a predetermined pattern, the predetermined pattern is printed with an image forming unit of the image forming apparatus.

The image forming apparatus may also include a pattern detector to detect the printed modified pattern, wherein the processor performs at least one of an auto color registration (ACR) and image density control on the detected modified pattern.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE EMBODIMENTS

Figure 1:
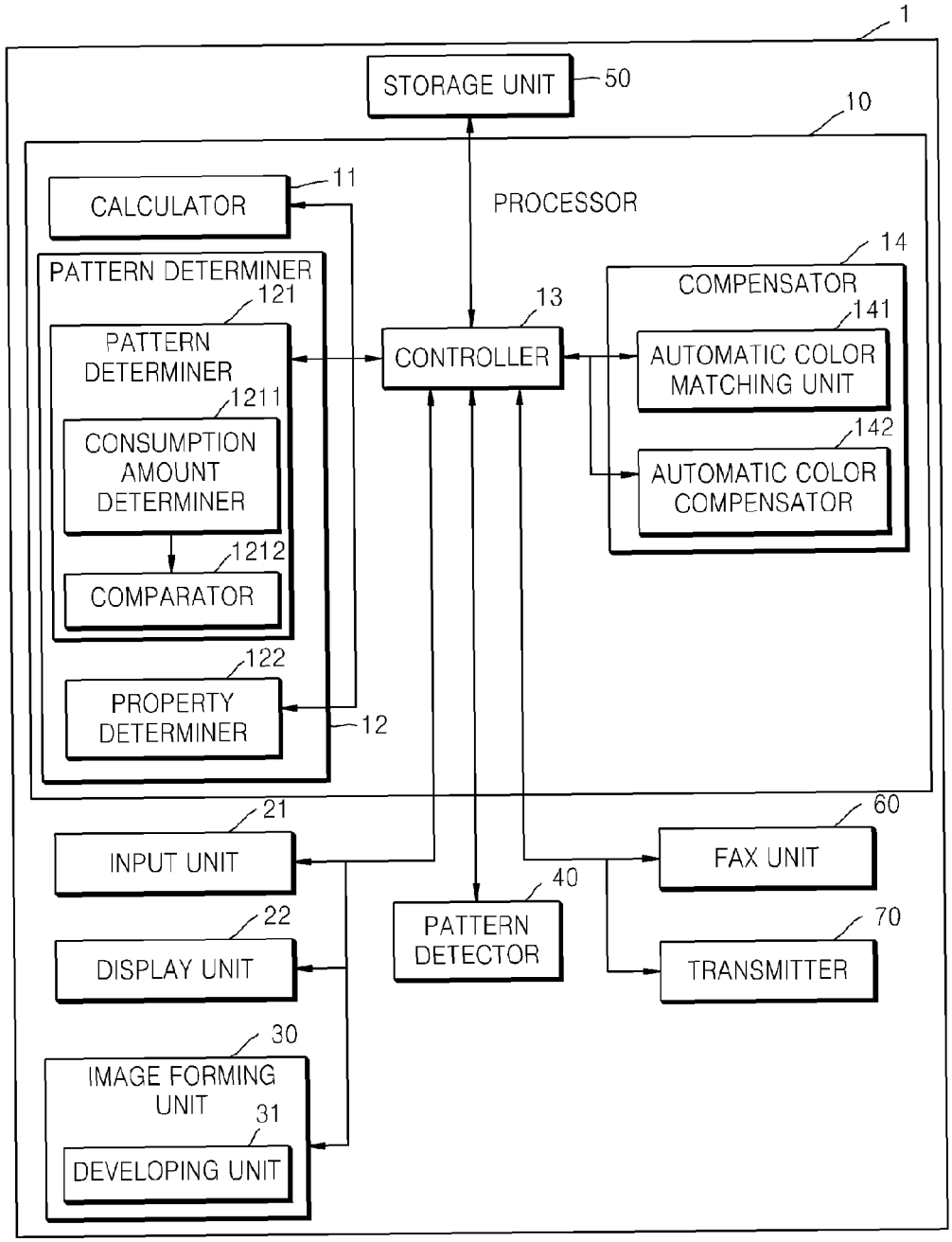
FIG. 1 illustrates a block diagram of an image forming apparatus according to exemplary embodiments of the present general inventive concept.

The present general inventive concept will now be described more fully with reference to the accompanying drawings, in which exemplary embodiments of the present general inventive concept are shown.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram of an image forming apparatus 1 according to exemplary embodiments of the present general inventive concept. Referring to FIG. 1, the image forming apparatus 1 can include a processor 10, an input unit 21, a display unit 22, an image forming unit 30, a pattern detector 40, a storage unit 50, a fax unit 60, and a transmitter 70. The processor 10 can include a calculator 11, a determiner 12, a controller 13, and a compensator 14. The determiner 12 can include a pattern determiner 121 which includes a consumption amount determiner 1211 and a comparator 1212 and a property determiner 122. The compensator 14 can include an automatic color matching unit 141 and an automatic color compensator 142. The processor 10 having the above structure may be realized as an array of logic gates (e.g., a Field Programmable Gate Array (FPGA), Programmable Logic Device (PLD), Application Specific Integrated Circuit (ASIC), and/or any suitable logic device and/or processor to carry out the exemplary embodiments of the present general inventive concept as disclosed herein), or a combination of a microprocessor and a memory to store programs which may be executed in the universal microprocessor. Also, it is obvious to one of ordinary skill in the art that the processor 10 may be realized with different kinds of hardware (e.g., logic devices, memory devices, etc.). In the present general inventive concept, the components relating to the exemplary embodiments of the present general inventive concept are described only. However, one of ordinary skill in the art would comprehend that other components, besides the components illustrated in FIG. 1, may be included in the image forming apparatus 1.

The image forming apparatus 1 may be a printer, a scanner, or a multi-functional apparatus. In particular, as many manufacturers participate in developing printers, laser beam printers increased performance in view of printing quality, printing speed, and noise during printing than conventional dot matrix printers or inkjet printers have been widely distributed. The laser beam printers can print images by attaching a toner on a photosensitive medium that has been scanned using a laser beam modulated as an image signal, transferring the toner attached on a surface of the photosensitive medium onto a printing medium, and fusing the toner on the printing medium using heat of high temperature and pressure. For the convenience of description, the image forming apparatus 1 denotes a laser beam printer, however, the exemplary embodiments of the present general inventive concept as disclosed herein is not limited thereto.

Operations of the image forming apparatus 1 to form images can include at least a charging operation, an exposure operation, a developing operation, a transferring operation, and a fusing operation. Color laser beam printers that can form color images by using laser beams have been distributed recently. The color laser beam printers can print color images by using toners of four colors, for example, cyan (C), magenta (M), yellow (Y), and black (K). That is, a developing unit 31 in the image forming unit 30 of the image forming apparatus 1 of the exemplary embodiments of the present general inventive concept includes four developers to supply the exemplary four toners of the exemplary four colors to four photosensitive media, respectively, and each of the developers includes a developing roller and a supplying roller. The four toners supplied to the four photosensitive media can be respectively developed to process a printing operation for each of the toners. In the transferring operation, the toners of the four colors can overlap each other by using an intermediate transfer belt (ITB) or a paper transfer belt (PTB) to transfer the toners at locations on the printing medium.

That is the image forming apparatus 1 can form the color images when toners are transferred onto the same location when they overlap each other on the printing medium. However, as the image forming apparatus 1 is used for increased periods of time (e.g., for a period greater than a predetermined period of time) or the number of printing operations are large, locations where the overlapping toners are transferred may be different from each other due to operational errors of the internal components of the image forming apparatus 1. Therefore, the toners of the four colors may not be transferred onto the same location, and a desired color may not be formed. Therefore, the printing quality of an image may be degraded and/or decreased. The toners of the four colors supplied from the developers may not be supplied at a constant density, and thus, the toners may not be combined at a predetermined density. Therefore, the desired color may not be not formed, and the printing quality of the image forming apparatus 1 may be degraded and/or decreased.

The image forming apparatus 1 can perform an auto color registration (ACR) operation and an image density (ID) control operation to minimize and/or prevent the printing quality from degrading for at least the reasons described above. The ACR operation may be an operation of checking whether the toner images of the four colors are appropriately aligned on a printing medium, and performing a correction if there is an alignment error in the aligned toner images. That is, the ACR operation can be an operation to synchronize the toner images of the Y, M, C, and K colors by re-arranging dots which are out of original positions (e.g., displaced from predetermined original positions) in a horizontal and/or longitudinal direction to overlap the toner images constantly at the same location, thereby realizing the desired color exactly. The ID control operation can be an operation to automatically perform a compensation to maintain a density of the toner supplied from the developing unit 31 or a density of the toner transferred on the printing medium.

The image forming apparatus 1 can perform the ACR or ID control operation when printing occurs regularly (e.g., at predetermined time intervals) or at a certain time (e.g., a predetermined time). That is, when conditions in which the ACR or ID control operation can be performed are set, the image forming apparatus 1 can perform the ACR or ID control operation when a predetermined operating condition occurs. For example, when the change of a temperature of a laser scanning unit (LSU) is equal to or greater that a predetermined reference temperature within a predetermined period of time, when the total number of printing operations is twice the number set (e.g., the total number of printing operations is twice a set predetermined amount), when a cover of the image forming apparatus 1 is opened or closed, and when components are replaced, the ACR or ID control operation may be performed. The above conditions can be, for example, set in a stage of fabricating the image forming apparatus 1, and/or may be received by the image forming apparatus 1 (e.g., from the input unit 21) and stored in the storage unit 50.

Figure 2A:
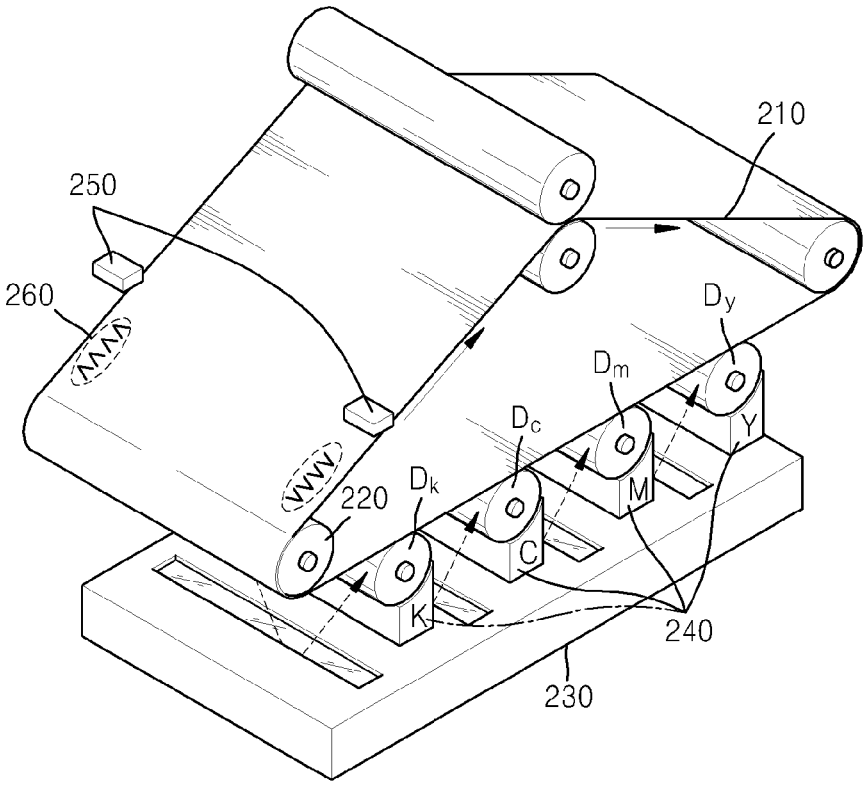
FIG. 2A illustrates a schematic diagram of an inner structure of the image forming apparatus of FIG. 1, according to the exemplary embodiments of the present general inventive concept.

FIG. 2A illustrates a schematic diagram of an internal structure of the image forming apparatus 1. Referring to FIG. 2A, the internal structure is that of a single-pass type image forming apparatus. An image forming apparatus such as the color laser beam printer that forms images of one or more colors as discussed above may be classified as a single pass type and a multi-pass type. The single pass type is a method of printing all of the colors at once (e.g., cyan, magenta, yellow, and black), and a single-pass type image forming apparatus can include a plurality of light scanning units and a plurality of developers. On the other hand, a multi-pass type image forming apparatus can print a toner image of one color by using one light scanning unit, and repeats the printing operation for each of the other colors. The internal structure of the image forming apparatus 1 of exemplary embodiments of the present general inventive concept disclosed herein may be applied to the multi-pass type image forming apparatus.

Referring to FIG. 2A, OPC (organized photo conductor) drum Dy, Dc, Dm, and Dk corresponding to the Y, C, M, and K toners can be installed in the image forming apparatus 1. An electrostatic image of a desired image can be formed on each of the OPC drum Dy, Dc, Dm, and Dk by a laser beam scanned from an exposure device 230, and the electrostatic image can be developed into the toner image in each developer 240. The toner images of the colors developed on the OPC drum Dy, Dc, Dm, and Dk can overlap each other on a transfer belt 210 which is circulated by the driving roller 220 to form a desired color image, and the desired color image can be printed on a side of a printing medium passing through the transfer belt 210 and a backup roller.

A pattern 260 that can be used in the ACR operation or a pattern (not illustrated) that can be used in the ID control operation can be formed by the exposure device 230, and printed on the transfer belt 210. A pattern detector 250 can detect the pattern 260 used in the ACR operation or the pattern (not illustrated) used in the ID control operation. The detected pattern 260 can be used in the ACR operation. In FIG. 2A, the pattern 260 that may be used in the ACR pattern is only printed, however, the pattern (not illustrated) that may be used in the ID control operation may be printed on the transfer belt 210.

Figure 2B:
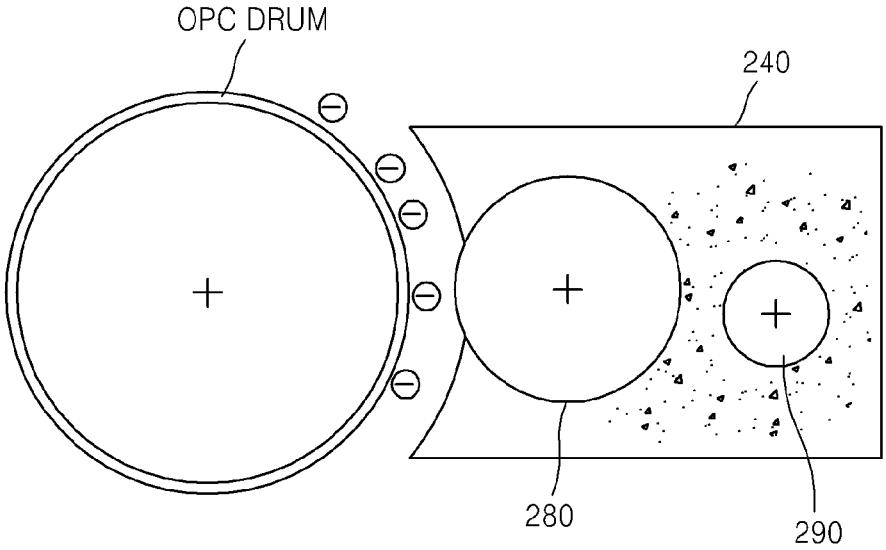
FIG. 2B illustrates a schematic diagram of an inner structure of one of a plurality of developers in the image forming apparatus of FIG. 2A, according to exemplary embodiments of the present general inventive concept.

FIG. 2B illustrates a schematic diagram of an internal structure of one of the developers 240 in the image forming apparatus 1 of FIG. 2A, according to exemplary embodiments of the present general inventive concept. Referring to FIG. 2B, the developer 240 can include a developing roller 280 and a supplying roller 290. The supplying roller 290 can supply the toner to the developing roller 280, and the developing roller 280 can develop the toner on the OPC drum Dy, Dc, Dm, or Dk. The printing quality of the image forming apparatus (e.g., the image forming apparatus 1 of FIG. 1) may be decreased and/or degraded due to, for example, a mechanical problem such as an error in operating the internal components of the image forming apparatus, as described above. However, besides the mechanical problem, the toner used in the printing operation may deteriorate, thereby degrading the printing quality of the image forming apparatus.

In more detail, the image forming apparatus (e.g., the image forming apparatus 1 of FIG. 1) can print the color image by using the toners of four colors, or toners of any other suitable number of colors to carry out the exemplary embodiments of the present general inventive concept. Therefore, the toner loaded in the developer 240 can be depleted, and the developing roller 280 can be provided with a new toner. Thus, the toner in the developer 240 may not be deteriorated (e.g., when new toner is loaded in the developer 240), and thus the characteristics of the toner may be maintained. Accordingly, the toner developed onto the OPC drum from the developing roller 280 can be printed on the printing medium by at least one printing process, and can be discharged out of the image forming apparatus. The toner that is not used in the developing operation can be returned into the developer 240 and can be separated from the developing roller 280 by a movement of the supplying roller 290. The toner separated from the developing roller 280 can be mixed with a newly supplied toner via the supplying roller 290, and can undergo the above printing processes again. That is, when the toner is not used in the developing operation but whirls in the developer 240 due to, for example, an idle run of the developing roller 280 when the color laser beam printer restarts for executing various operations, an idle run of the developing rollers 280 which supply the toners which are not used in a mono-color mode printing operation, or an idle run of the developing roller 280 caused when the color laser beam printer transits from the standby status to the printing mode, a property of the toner such as, for example, durability is degraded due to pressure and frictional heat between the supplying roller 290 and the developing roller 280, and thereby, particles of the toner become smaller and the toner is deteriorated. The deteriorated toner may decrease the printing quality, and thus, the toner may be removed.

The deteriorated toner can be discharged to a device to collect waste toner. In the image forming apparatus (e.g., the image forming apparatus 1 of FIG. 1) of exemplary embodiments of the present general inventive concept, the deteriorated toner may not be discharged, but may be used in the ACR operation or ID control operation, which is previously described above.

In more detail, patterns which can be printed to perform the ACR or ID control operation are printed only inside the image forming apparatus (e.g., the image forming apparatus 1 of FIG. 1), and thus, users may not see the printed patterns from the outside of the image forming apparatus. The ACR operation and/or ID control operation can adjust locations of the developers or can adjust the density of toners supplied from the developers. That is, the ACR operation and/or the ID control operation may not decrease and/or degrade the quality of toner. When the ACR and/or ID control operation is performed by using the patterns which are printed using the deteriorated toner, an accuracy of the ACR or ID control operation may not be affected. In the image forming apparatus (e.g., the image forming apparatus 1 of FIG. 1) of exemplary embodiments of the present general inventive concept, the deteriorated toner may not be discharged, but can print the patterns so that the ACR or ID control operation may be performed when the deteriorated toner is consumed.

Referring to FIG. 1 again, the deterioration of the toner may generate a blur in the image printed on the printing medium or a vertical and/or horizontal streak, and thus, the printing quality can be degraded. The developer can print the patterns with the deteriorated toner so that the image forming apparatus 1 may print the image with a predetermined (e.g., constant) printing quality. The image forming apparatus 1 of the exemplary embodiments of the present general inventive concept can calculate a toner stress index (TS_index) to represent the deteriorated degree of the toner, and can print the patterns with the deteriorated toner according to the calculated TS_index to perform the ACR and/or ID control operation, thereby compensating for the printing quality.

The calculator 11 can calculate the TS_index which represents the deteriorated degree of the toner remaining in the developers. The TS_index may be calculated, for example, whenever the image forming apparatus 1 performs the printing operation. The TS_index may be calculated under a predetermined condition, for example, every 30 pages of printing media, at predetermined time intervals, and/or predetermined intervals in a printing operation. However, one of ordinary skill in the art may change the period of calculating the TS_index.

The TS_index may be calculated according to at least one of an average dot count of the image forming apparatus 1 and the number of rotations of the developing roller which is included in each of the developers per one page of printing. In more detail, the TS_index may be calculated according to at least one of a use rate which is calculated according to a ratio of dots used to print a page of printing medium in the image forming apparatus 1 and a revolution rate which is calculated according to the number of rotations of the developing roller with respect to the number of pages printed during one printing job. That is, the calculator 11 can calculate at least one of the use rate and the revolution rate, and can calculate the TS_index according to the calculated use rate or the revolution rate. The deterioration of the toner can be affected by the use rate and the revolution rate, which will be described below.

The revolution rate may be calculated (e.g., by the processor 10 of the image forming apparatus illustrated in FIG. 1, and/or the calculator 11) by using the following Equation 1.

$$RR = \frac{TREV}{TPG} \quad \text{(Equation 1)}$$

Referring to FIG. 1, RR denotes the revolution rate, and TPG denotes a total page count, which is the total number of pages printed during a certain printing job. TREV denotes a total revolution of the developing roller during the certain printing job. When the revolution rate increases, the TS_index can increase, which will be described below.

A printing job input by the user may print one page, two pages, or more. During the performing of the printing job, the image forming apparatus 1 can apply a high voltage to the internal devices, including the developing rollers, to drive the internal devices before printing the printing job, and releases the high voltage applied to the internal devices to stop the driving of the internal devices after completing the printing job. For example, before starting the printing operation and after completing the printing operation on the printing media, the toner may not be used to perform the printing operation, and thus the toner can remain in the developers. Therefore, the toner in the developers, which may not be used in the printing operation, can be degraded due to, at least in part, the driving of the developing rollers and the supplying rollers in the developer. When the above operation is repeated, the durability of the toner can be decreased and/or weakened, and the toner can be deteriorated.

When a printing operation is performed, the time taken to start driving the developing rollers before the printing operation, the time taken to stop driving the developing rollers after the printing operation, and the time taken to print one page may be similar to each other or the same. When it is assumed that one page is printed in a printing job and ten pages are printed in another printing job, the revolution rate of the developing rollers in the one-page printing job may be greater than that of the ten-page printing job. The driving of the developing rollers and the stopping of the developing rollers can be repeated whenever the printing job of one page is started and ended, in order to print ten pages of printing media. When ten pages are printed through one, printing job, the driving and stopping of the developing rollers may not repeated. The less the number of pages printed in one printing job is, the more the revolution rate of the developing rollers is.

The more the revolution rate of the developing rollers is, the faster the deterioration of the toner is. That is, the revolution rate of the developing rollers can be one of the elements for calculating the TS_index.

For example, it can be assumed that it takes 8.3 seconds to drive the developing rollers by applying the high voltage to the internal devices of the image forming apparatus 1 before starting the printing operation, it can take 3 seconds to print one page of printing medium, and it can take 6.6 seconds to stop driving the developing rollers by releasing the high voltage after performing the printing operation. In addition, it can be assumed that the developing roller makes 2.7 revolutions per second. One printing job can be to print one page, and the image forming apparatus 1 can operate for 17.9 seconds, and the developing roller makes 48.33 revolutions. Therefore, the revolution rate can be calculated as 48.33 according to equation 1. When one printing job is for printing ten pages, the image forming apparatus 1 operates for 44.9 seconds and the developing roller makes 121.23 revolutions. Therefore, the revolution rate of the developing roller can be calculated as 12.12 according to Equation 1. That is, when the number of pages printed in one printing job increases, the revolution rate is reduced. When the revolution rate is reduced, the toner in the developing roller is mainly used in the printing job, and the toner in the developing roller is less affected by the driving of the developing roller. Therefore, the TS_index is reduced.

Figure 3:
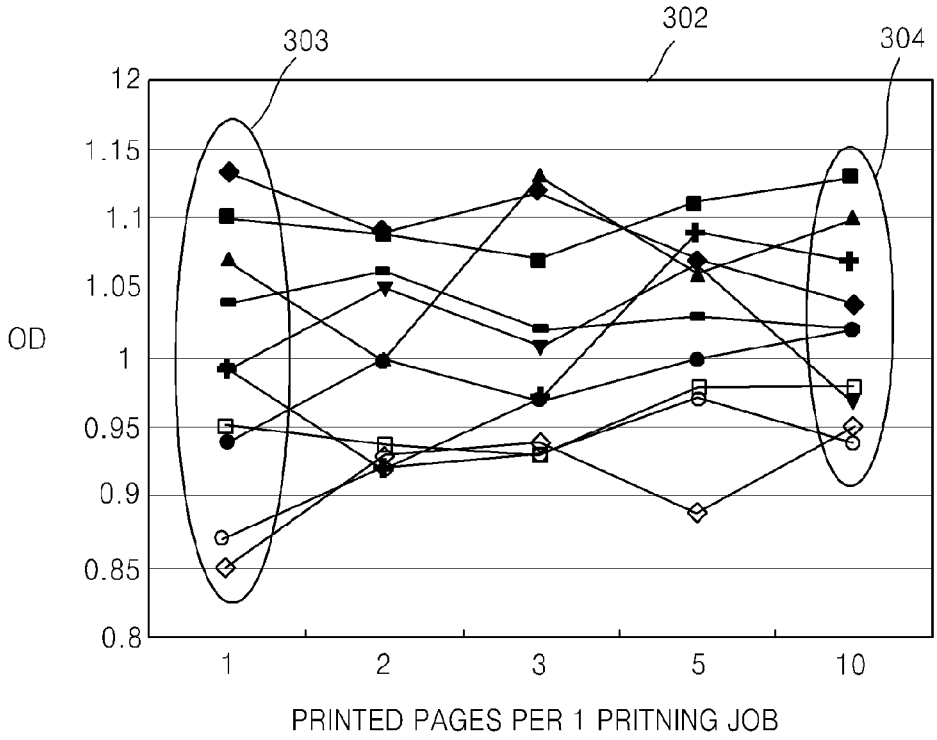
FIG. 3 is a table and a graph illustrating a relation between a revolution rate and an optical density (OD) in the image forming apparatus according to exemplary embodiments of the present general inventive concept.

FIG. 3 is a table 301 and a graph 302 illustrating a relation between the revolution rate and an optical density (OD) in the image forming apparatus according to exemplary embodiments of the present general inventive concept. Referring to FIG. 3, the table 301 and the graph 302 represent the relation between the revolution rate and the OD. The OD denotes a developed amount of the toner on the printing media, that is, a density of the image. Therefore, when the OD is maintained to be the same and/or similar (e.g., maintained constant), the printing quality can be improved.

Referring to the table 301 representing the relation between the revolution rate and the OD, the revolution rate can be reduced when the number of pages printed in one printing job increases. The table 301 illustrates data which can be obtained by measuring the OD according to the revolution rate every 600 pages, and the graph 302 illustrates the measured data.

Referring to the graph 302 that illustrates the relation between the revolution rate and the OD, a distribution of OD 303 where one page is printed through one printing job can be denser than a distribution of OD 304 where ten pages are printed through one printing job. That is, the OD according to the low revolution rate can be stably distributed and less varied. In other words, since the toner can be less deteriorated when the revolution rate is decreased, the printing quality can be increased over that of an increased revolution rate.

Referring to FIG. 1 again, the image forming apparatus 1 such as the color laser beam printer can mix four colors, that is, C, M, Y, and K, in order to perform the color printing operation, the developing unit 31 of the image forming apparatus 1 of exemplary embodiments of the present general inventive concept includes four developers, and accordingly, the revolution rate of each of the developers can be calculated. This is because the mixing ratio of the CMYK may be varied according to, among other things, the desired color. Thus, the degree of driving the developing roller in each developer can be different.

As described above, the calculator 11 can calculate the use rate, in addition to the revolution rate in order to calculate the TS_index. The use rate can be calculated according to a ratio of printed dots per one page, in more detail, an average dot count of the printing media with respect to the international standardization organization (ISO) standard dot count is calculated, as represented by the following Equation 2.

$$UR = \frac{TDC}{STDDC \times TPG} \quad \text{(Equation 2)}$$

Referring to Equation 2, UR denotes the use rate. The ISO standard dot count (STDDC) can be a ratio of printed dots per one page set by the ISO, and may be 5%. TDC denotes the total dot count, which represents a ratio of dots printed in the printing medium. TPG denotes the total page count: Therefore, when TDC is divided by TPG, an average dot count per one page is obtained. When the UR is increased, the TS_index is decreased, as will be described in more detail below.

The UR denotes the dot counts used per page. Therefore, when the UR is decreased, a decreased amount of toner may be used to perform the printing operation. In other words, the dot count per page is decreased. When the dot count per page is decreased, it may take an increased amount of time to use the toner in the developer in a printing operation, and thus, the toner can be deteriorated in the developer. That is, the UR may mean the amount of time for toner to remain in the developer. As described above, when the toner remains in the developer for increased periods of time (e.g., a period of time that is greater than or equal to a predetermined time period), the deterioration of the toner can be accelerated.

Figure 4:
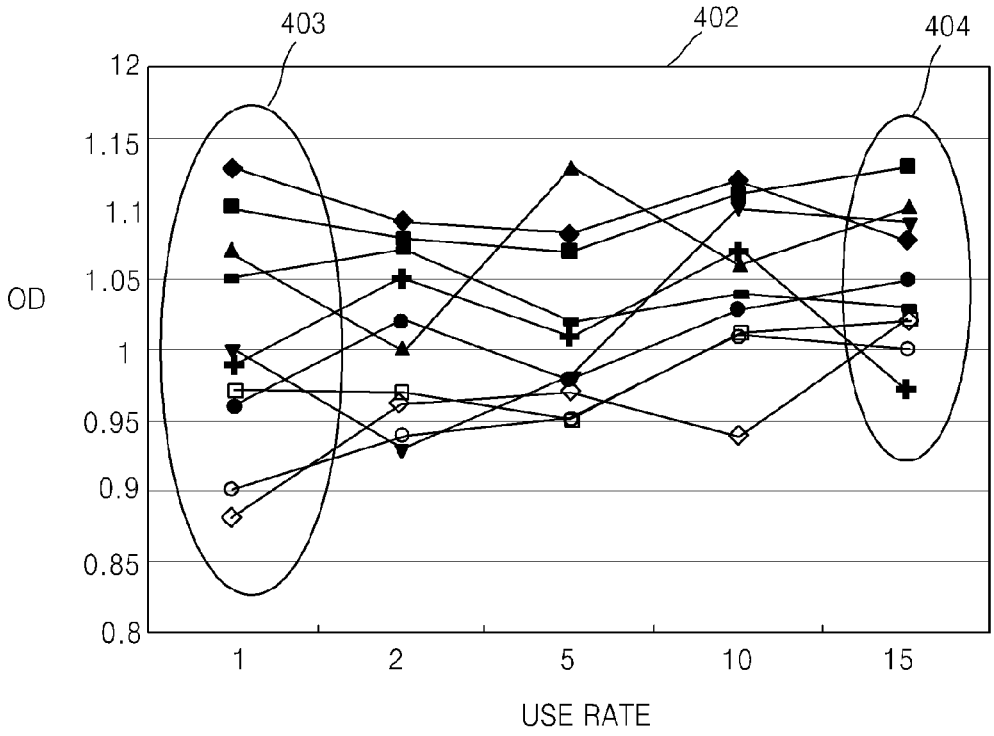
FIG. 4 is a table and a graph illustrating a relation between a use rate and an OD in the image forming apparatus according to exemplary embodiments of the present general inventive concept.

FIG. 4 is a table 401 and a graph 402 illustrating a relation between the UR and the OD in the image forming apparatus according to exemplary embodiments of the present general inventive concept. In FIG. 4, the table 401 and the graph 402 representing the relation between the UR and the OD are illustrated. As described above, when the OD is maintained constant, the printing quality is improved.

Referring to the table 401 representing the relation between the UR and the OD, data which is obtained by measuring the OD according to the UR every 600 pages is illustrated, and the graph 402 is obtained from the measured data. Referring to the graph 402 representing the relation between the UR and the OD, a distribution of OD 403 when the UR is 1 is denser than a distribution of OD 404 when the UR is 10. That is, the OD where the UR is 10 may be more stably distributed and less varied than the OD where the UR is 1. In other words, when the UR is increased, the toner use in the printing operation may be increased, and the toner may be less deteriorated. Therefore, when the UR is increased, the printing quality can be improved.

Referring to FIG. 1 again, the image forming apparatus 1 such as the color laser beam printer can include a plurality of developers, and the UR of each of the plurality of developers can be calculated. As the mixing ratio of the CMYK may vary according to the desired color, the UR of the toner in each developer can be different.

As described above, the revolution rate and/or the UR can affect the toner deterioration. The calculator 11 can calculate the TS_index according to the revolution rate and the UR. As described above, when the revolution rate is increased and the UR is decreased, the toner can be deteriorated at an increased rate. Therefore, the TS_index can be proportional to the revolution rate, and can be inverse-proportional to the UR. The above relation may be represented as the following Equation 3.

$$\text{TS_Index} = \frac{RR}{UR} \times NI \quad \text{(Equation 3)}$$

Referring to Equation 3, NI is a predetermined constant that may be stored, for example, in the storage unit 50 of the image forming apparatus 1 illustrated in FIG. 1 and/or received from the input unit 21. As described above, the TS_index is proportional to the RR and inverse-proportional to the UR. The calculator 11 can calculate the TS_index of the toner in each of the developers to measure the deteriorated degree of the toner.

Referring to FIG. 1 again, the developing unit 31 of the image forming unit 30 prints the patterns on an intermediate transfer belt or a paper transfer belt. Since the developing unit 31 of the exemplary embodiments of the present general inventive concept includes a plurality of developers, the patterns are printed by each color toner unit. In general, the pattern may be substituted by a terminology of patch.

In more detail, the image forming apparatus 1 such as the color laser beam printer can output a test page to test a density of the ink or toner and consistency of forming images. The patterns used in this test may include a pattern for the ACR operation and/or a pattern for the ID control operation. The pattern for the ACR operation can be used in an operation of matching the color images to form one color image by combining the toner images. In addition, the ACR pattern can be used in an operation of maintaining the density of the toner which is supplied from each of the developers to overlap the pattern for the ID control operation and one or more colors of toner (e.g., each color toner). The patterns of the exemplary embodiments of the present general inventive concept may include a default pattern (e.g., predetermined pattern) that can be used in at least one of the ACR operation and the ID control operation, and a modification pattern which can be obtained by changing the number of default patterns or the width of the default pattern.

Figure 5:
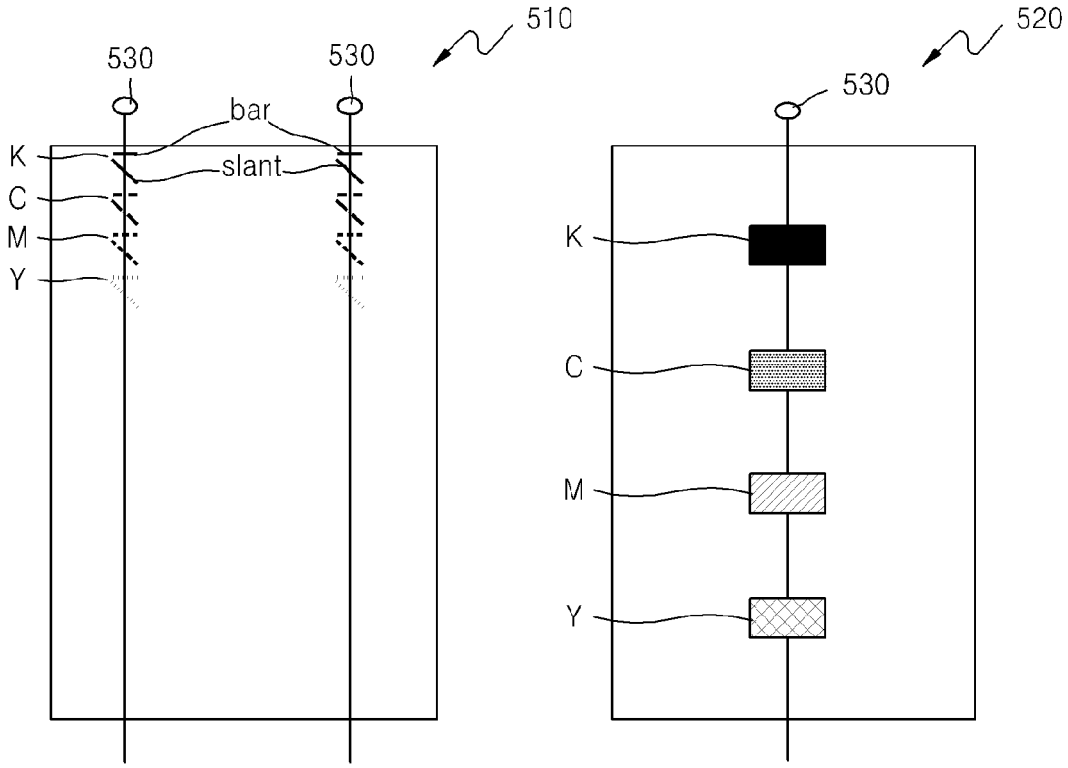
FIG. 5 is a diagram illustrating default patterns to compensate for printing quality.

FIG. 5 illustrates default patterns to compensate for the printing quality. Referring to FIG. 5, a default pattern 510 disposed on a left side of FIG. 5 is a pattern that can be used in the ACR operation, and a default pattern 520 disposed on a right side of FIG. 5 is a pattern that can be used in the ID control operation. The default patterns 510 and 520 can be printed as illustrated in FIG. 2, and detected by a pattern detector 530. That is, the ACR operation can be performed by detecting locations of bars and slants of the exemplary four colors illustrated in the default pattern 510, and by analyzing the detected locations. In addition, the ID control operation is performed by detecting thicknesses of the four colors illustrated in the default pattern 520, and analyzing the detected thicknesses to check that the toner can be used to a predetermined density. The ACR and the ID control operations that use the default patterns 510 and 520 are well known in the art, and thus, detailed descriptions thereof are not provided here.

Referring to FIG. 1, the determiner 12 can include the pattern determiner 121, which includes the consumption amount determiner 1211 and the comparator 1212, and a property determiner 122.

For every developer, the pattern determiner 121 can determine one of the default pattern and the modification pattern according to the calculated TS_index before performing at least one of the ACR operation and the ID control operation. When the modification pattern is determined, the property determiner 122 can determine the property of the modification pattern. The property of the modification pattern can mean at least one of the number of patterns, a width of a main scanning direction of the pattern, and a width of a sub-scanning direction of the pattern. As described above, the image forming apparatus 1 of the exemplary embodiments of the present general inventive concept can print the patterns, the number and width of which are changed, by using the deteriorated toner according to the TS_index, instead of discharging the deteriorated toner. Therefore, the deteriorated toner can be used, and the accuracy of the ACR operation or ID control operation can be improved.

In more detail, the pattern determiner 121 can include the consumption amount determiner 1211 which can determine the consumption amount of the remaining toner in each of the developers, which corresponds to the TS_index calculated by the calculator 11, and the comparator 1212 which can compare the consumption amount with a threshold value of the toner amount used in printing the default patterns. According to the comparing result of the comparator 1212, the pattern determiner 121 can determine the pattern. That is, when the determined consumption amount is less than the threshold value as the comparing result, the pattern determiner 121 can determine the pattern to be printed as the default pattern.

However, when the determined consumption amount is greater than the threshold value, the pattern determiner 121 can determine the pattern to be printed as the modification pattern, and the property determiner 122 can determine the property of the modification pattern to use the remaining toner as much as the determined consumption amount. The controller 13 can control the image forming apparatus 1 to print the modification pattern having the determined property. When the determined consumption amount is greater than the toner amount which may be consumed by printing the modification pattern, the controller 13 can control the image forming apparatus 1 to print the modification pattern more to use the remaining toner as much as the exceeding consumption amount. The threshold value may be modified by the user (e.g., when designing the image forming apparatus 1) or may be automatically adjusted by the image forming apparatus 1 according to the usage environment.

The property determiner 122 can determine the property of the modification pattern with respect to one or more of the developers (e.g., each of the developers) by increasing at least one of the number of default patterns, the width of the main scanning direction of the default pattern, and the width of the sub-scanning direction of the default pattern according to the calculated TS_index. That is, when the consumption amount of the toner determined by the consumption amount determiner 121 is greater than the threshold value, the property determiner 122 can increase at least one of the number of default patterns, the width of the main scanning direction of the default pattern, and the width of the sub-scanning direction of the default pattern so as to use more toner. As described above, the consumption amount of the deteriorated toner may be adjusted according to the property of the modification pattern, and thus, an additional operation for discharging the deteriorated toner may not be required. The ACR and the ID control operations may be performed with one or more modification pattern samples, and accordingly, the printing quality may be compensated accurately.

Figure 6:
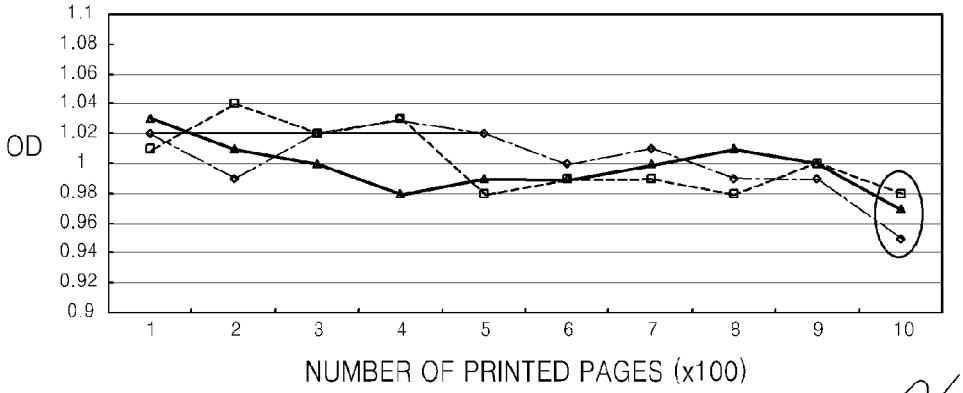
FIG. 6 includes a table and graphs illustrating changes in the OD when a modification pattern is printed with the deteriorated toner according to the calculated toner stress index and when the modification pattern is printed not by using the deteriorated toner according to exemplary embodiments of the present general inventive concept.
Figure 6:
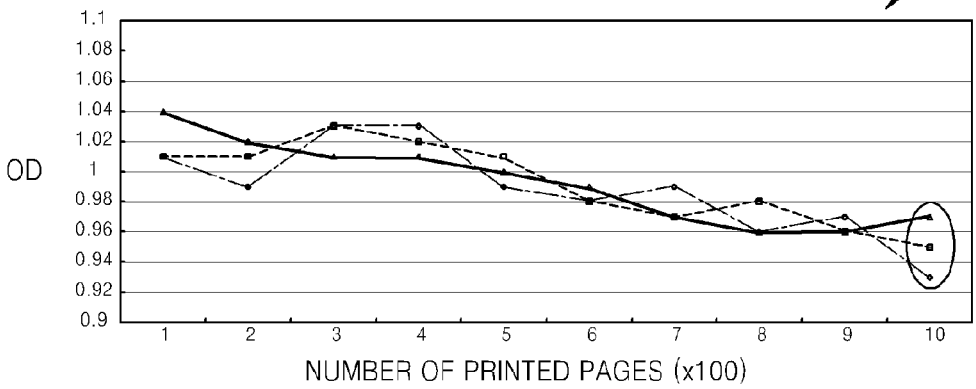
Figures 7, 8:
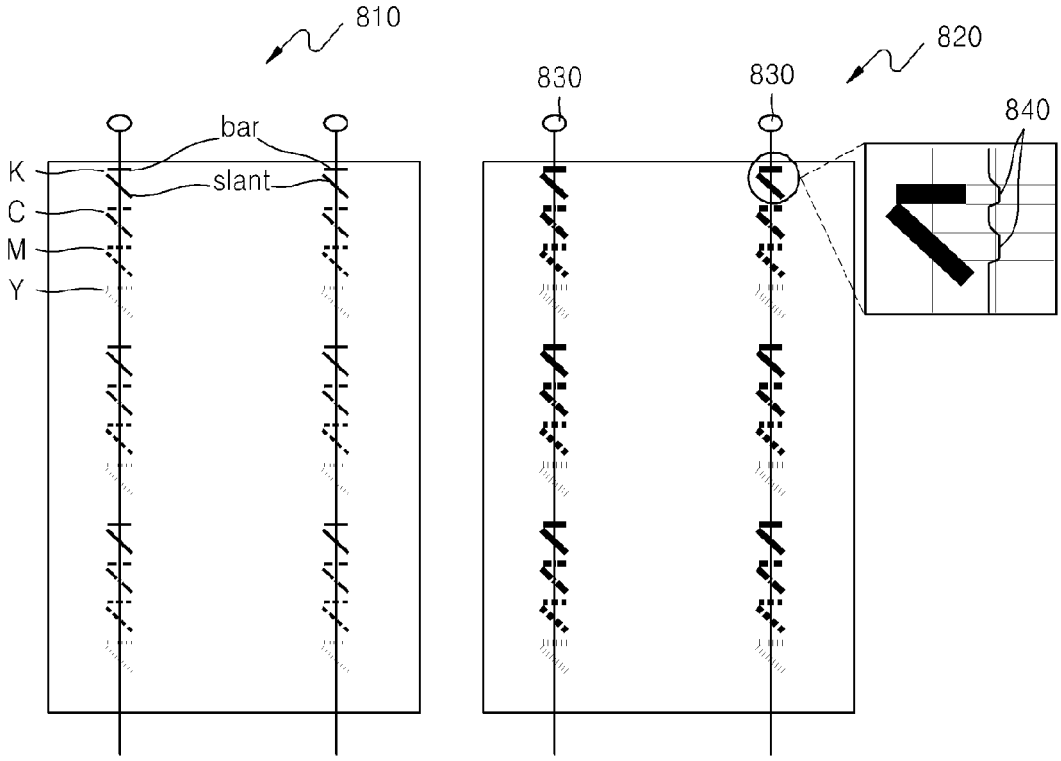
FIG. 7 is a table illustrating toner consumption amounts according to a toner stress index of exemplary embodiments of the present general inventive concept.
FIG. 8 is a diagram illustrating modification patterns in the image forming apparatus, according to exemplary embodiments of the present general inventive concept.

FIG. 6 is a table 601 and graphs 602 and 603 illustrating changes in the OD when the modification pattern is printed with the deteriorated toner according to the TS_index and when the modification pattern is printed not by using the deteriorated toner. FIG. 7 is a table illustrating toner consumption amounts according to the TS_index.

Referring to FIG. 6, the table 601 illustrates the OD measured when the modification pattern is printed with the deteriorated toner according to the calculated TS_index and the OD which is measured when the modification is not printed by using the deteriorated toner, the graph 602 illustrates a change in the OD when the modification pattern is printed by using the deteriorated toner according to the calculated TS_index, and the graph 603 illustrates a change in the OD when the modification pattern is not printed by using the deteriorated toner. Here, the modification pattern can be printed by using the deteriorated toner according to the table of FIG. 7.

The graph 602 illustrating the change in the OD when the modification pattern can be printed by using the deteriorated toner according to the calculated TS_index and the graph 603 illustrating the change in the OD when the modification pattern is not printed by using the deteriorated toner are according to the data illustrated in the table 601. When the changes in the OD illustrated in the graphs 602 and 603 are compared with each other, as the printing operation is performed, the OD when the modification pattern is not printed by using the deteriorated toner may have an increased reduction rate than that of the case where the modification pattern is printed by using the deteriorated toner according to the TS_index. This result illustrates that an increased amount of the deteriorated toner remains in the developer when the modification pattern is not printed by using the deteriorated toner, and thus, the printing quality is degraded. On the other hand, when the modification pattern is printed by using the deteriorated toner, the developer uses the deteriorated toner. Therefore, even when an increased number of printing operations are performed (e.g., the number of printing operations performed is greater than a predetermined number), the printing quality can be increased over that where the deteriorated toner is not used.

FIG. 8 is a diagram illustrating modification patterns 810 and 820 according to exemplary embodiments of the present general inventive concept. Referring to FIG. 8, the modification patterns 810 and 820 that can be used in the ACR operation are illustrated. When the modification patterns 810 and 820 are compared with the default pattern 510 illustrated in FIG. 5, the modification pattern 810 can be obtained by increasing the number of patterns, and the modification pattern 820 can be obtained by increasing the number of patterns and the width of the pattern in the scanning direction. As described above, as a comparing result of the comparator 122, when the determined consumption amount does not exceed the threshold value and there is deteriorated toner to be used to print the modification pattern, the properties of the modification pattern 810 and/or 820 can be adjusted to increase the use of the deteriorated toner. Therefore, as described above, toner having increased deterioration can be used to print a modification pattern by increasing at least one of the number of default patterns and the width of the default pattern in the main scanning direction.

When the number of default patterns is increased or the width of the default pattern in the main scanning direction is increased, the accuracy of the ACR operation can be improved. This is at least because the number of bars and slants to be detected can increase when the number of default patterns is increased, and accordingly, the number of samples to be analyzed is increased. When the width of the default pattern is increased, a peak portion 840 of a waveform detected by a pattern detector 830 can become wider for a bar and a slant, and thus, the locations of the bars and slants may be detected.

Figure 9:
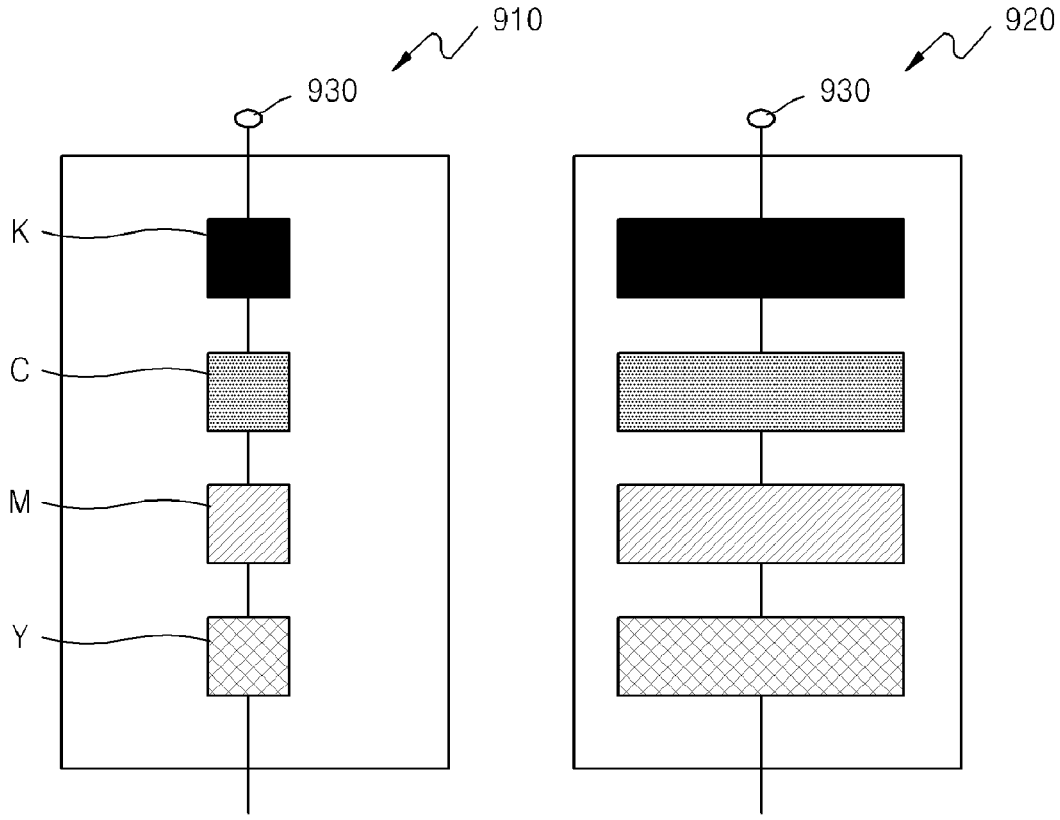
FIG. 9 is a diagram illustrating modification patterns in the image forming apparatus according to exemplary embodiments of the present general inventive concept.

FIG. 9 is a diagram illustrating modification patterns 910 and 920 according to exemplary embodiments of the present general inventive concept. Referring to FIG. 9, the modification patterns 910 and 920 that may be used in the ID control operation are illustrated. When the modification patterns 910 and 920 are compared with the default pattern 520 illustrated in FIG. 5, the modification pattern 910 can be obtained by increasing the width of the default pattern 520 in the main scanning direction, and the modification pattern 920 can be obtained by increasing the width of the default pattern 520 in the sub-scanning direction. As described above, as a comparing result of the comparator 122, when the determined consumption amount does not exceed the threshold value and there is a predetermined amount of deteriorated toner (e.g., the amount of deteriorated toner is equal to or greater than a predetermined value) to be used to print the modification pattern, the properties of the default pattern 520 can be adjusted to use the deteriorated toner more in printing the modification pattern. Therefore, toner having increased deterioration can be used to print a modification pattern by increasing at least one of the width of a default pattern in the main scanning direction and the width of the default pattern in the sub-scanning direction. When at least one of the width of the default pattern in the main scanning direction and the width of the default pattern in the sub-scanning direction is increased, the accuracy of the ID control operation can be improved. This is because, for example, as the width of the default pattern in the main scanning direction and the sub-scanning direction increases, the number of samples detected by the pattern detector 930 can be increased.

Figure 10:
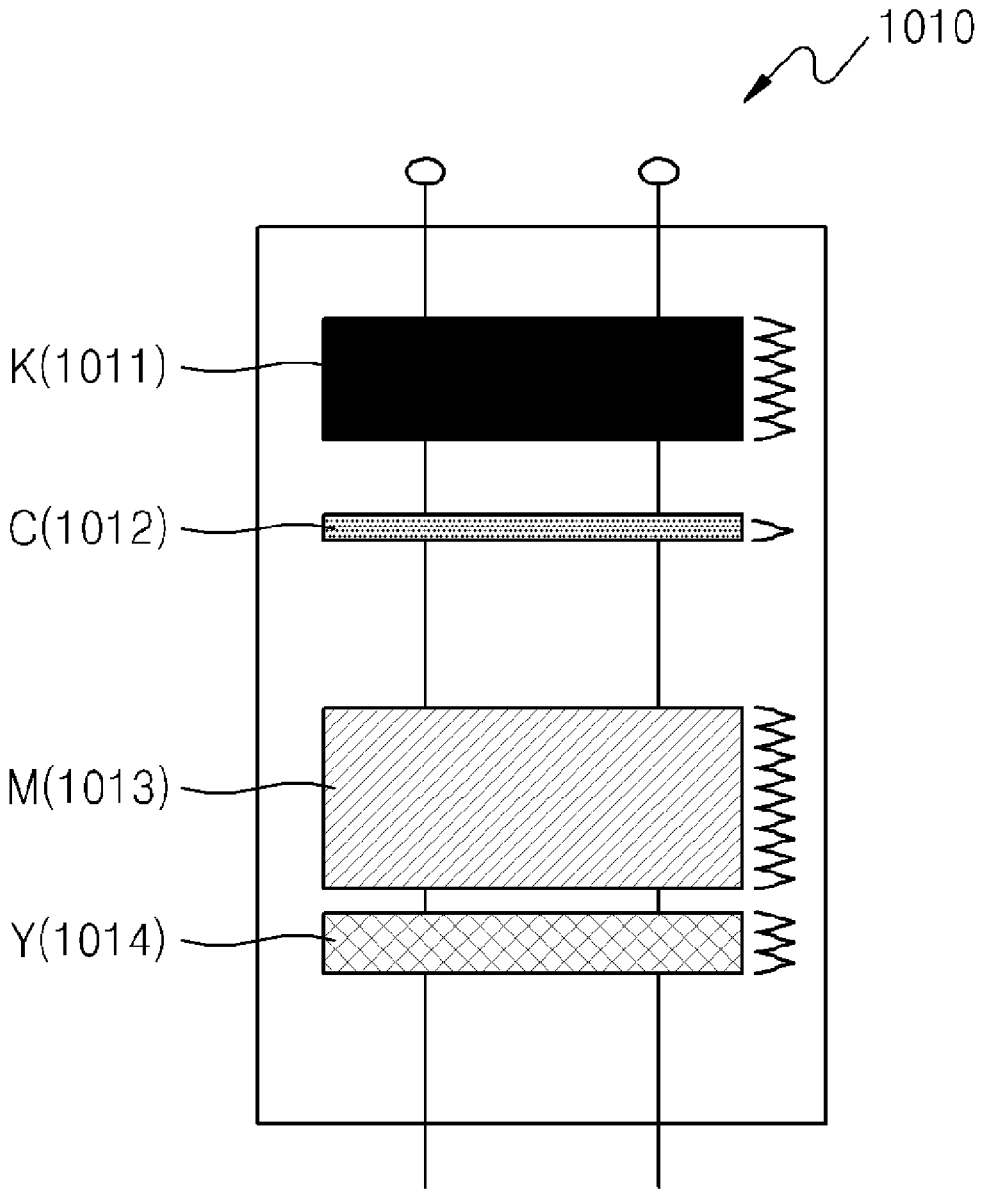
FIG. 10 is a diagram illustrating modification patterns in the image forming apparatus according to exemplary embodiments of the present general inventive concept.

FIG. 10 is a diagram illustrating a modification pattern 1010 according to exemplary embodiments of the present general inventive concept. Referring to FIG. 10, in the modification pattern 1010, colors of K (1011), C(1012), M(1013), and Y(1014) may have different widths from each other in the main scanning direction. The image forming apparatus 1 can include the plurality of developers to develop toners of different colors, and usage rate of each of the developers can be different from those of the other developers. Therefore, the TS_index of each of the developers may be different from those of the other developers, and thus, the widths of the toners of different colors in the developers may be different from each other as illustrated in FIG. 10.

Figure 11:
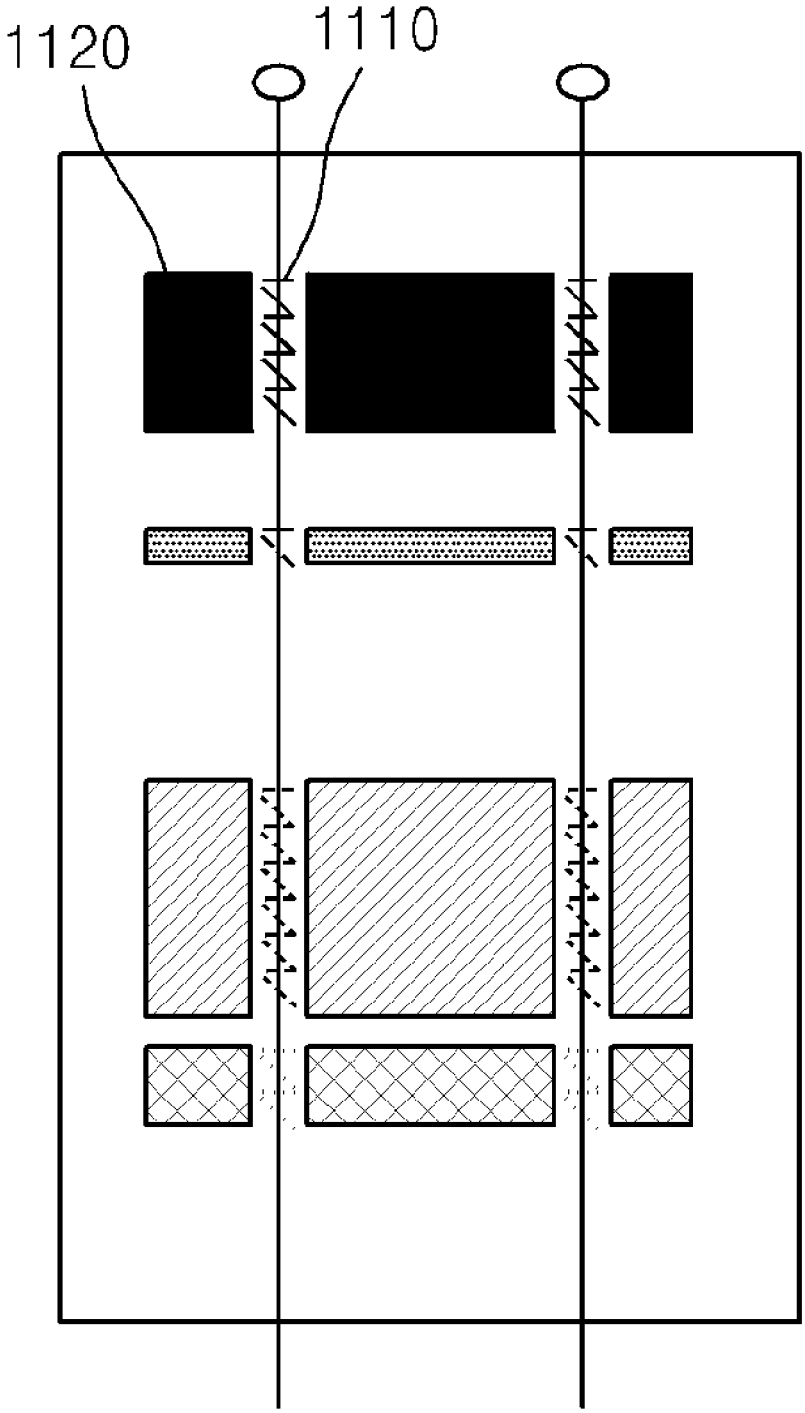
FIG. 11 is a diagram illustrating modification patterns in the image forming apparatus according to exemplary embodiments of the present general inventive concept.

FIG. 11 is a diagram illustrating modification patterns 1110 and 1120 according to exemplary embodiments of the present general inventive concept. Referring to FIG. 11, the modification pattern 1110 that can be used in the ACR operation and the other modification pattern 1120 that can be printed in another region are illustrated. When the determined consumption amount exceeds the toner amount which may be consumed to print the modification pattern, another pattern can be printed by using the exceeding toner amount when printing the modification pattern 1110 used in the ACR operation. The modification pattern 1110 and the modification pattern 1120 can have different widths from each other in the main scanning direction because the TS_indexes of the developers can be different from each other.

As described above, the property of the modification pattern can be adjusted with respect to each of the developers according to the calculated TS_index, and then, the deteriorated toner can be used to print the modification pattern when performing at least one of the ACR operation and the ID control operation, and accordingly, the TS_index of the toner may be maintained at a constant level and the printing quality of the image forming apparatus 1 may be improved. In exemplary embodiments of the present general inventive concept, there may be no need to discharge the deteriorated toner separately, and the standby time when performing the printing operation may be reduced.

Referring to FIG. 1 again, the pattern detector 40 can detect the default pattern and/or the modification pattern to perform the ACR and/or ID control operation. The compensator 14 can analyze the pattern detected by the pattern detector 140 to perform the ACR operation or ID control operation. That is, the automatic color matching unit 141 can analyze the detected patterns to adjust the locations of the developers, and the automatic color compensator 142 can analyze the detected patterns to adjust the density of the toner supplied from each of the developers.

The controller 13 can control the operation of the internal devices in the image forming apparatus 1. For example, the controller 13 can control the developing unit 31 to print the modification pattern according to the property determined by the determiner 12, and can control the compensator 14 to perform the compensation of the printing quality by detecting the printed pattern.

The image forming unit 30 can print desired images on the printing media through the one or more processes of charging, exposing, developing, transferring, and fusing. That is, the image forming unit 30 can perform the printing operation of document files transferred from a host device. The developing unit 31 of the image forming unit 30 can include the plurality of developers, and can print the default patterns or the modification patterns on the intermediate transfer belt or the paper transfer belt.

The storage unit 50 can store equations to calculate the TS_index in the calculator 11, the calculated TS_index, the toner consumption amount corresponding to the TS_index. The storage unit 50 can include the calculated RR and UR. When calculating the TS_index, the calculator 11 can read at least one of the RR and UR stored in the storage unit 50, and can calculate the TS_index by using the read RR and/or UR. That is, the data stored in the storage unit 50 can be read according to the operations of the internal devices in the image forming apparatus 1.

The input unit 21 can receive a command to perform at least one of the ACR operation and the ID control operation. The input unit 21 can receive information about settings to perform the ACR and the ID control operations. As described above, the image forming apparatus 1 may perform the ACR and/or ID control operation regularly or whenever a predetermined event occurs. The image forming apparatus 1 may perform the ACR and/or ID control according to the command input in the input unit 21.

The user and/or manager of the image forming apparatus 1 may input the command into the input unit 21 via an operation panel such as a keyboard or a touch screen. The user and/or the manager of the image forming apparatus 1 may input the command into the input unit 21 via an application (for example, a smart panel or a printer driver) of a host computer, which can be connected to the image forming apparatus 1. For example, the host computer may be communicatively connected to the image forming apparatus via a wired and/or wireless communication network. The user and/or the manager of the image forming apparatus 1 may input the command into the input unit 21 via a solution (for example, syncthru or counthru) of a management server which can control a plurality of image forming apparatuses including the image forming apparatus 1 of exemplary embodiments of the present general inventive concept, or a web user interface (UI) provided by an embedded web server (EWS) included in the image forming apparatus 1.

The display unit 22 can display at least one of the current TS_index, the toner consumption amount corresponding to the current TS_index, the property of the pattern, the result of performing the ACR operation, and the result of performing the ID control operation. That is, the display unit 22 can display the results of processes performed in the image forming apparatus 1 with, for example, a liquid crystal display (LCD) and/or any other suitable display to carry out the exemplary embodiments of the present general inventive concept as disclosed herein.

The fax unit 60 and the transmitter 70 can perform one or more functions of the image forming apparatus 1. The fax unit 60 can transmit the document file transmitted from the host device via a fax unit. The transmitter 70 can transmit the document file transmitted from the host device to the networks such as a server, a mobile storage medium, or a computer system when a network interface is connected and when a destination is input (e.g., a destination network address may be entered in advance).

Figure 12:
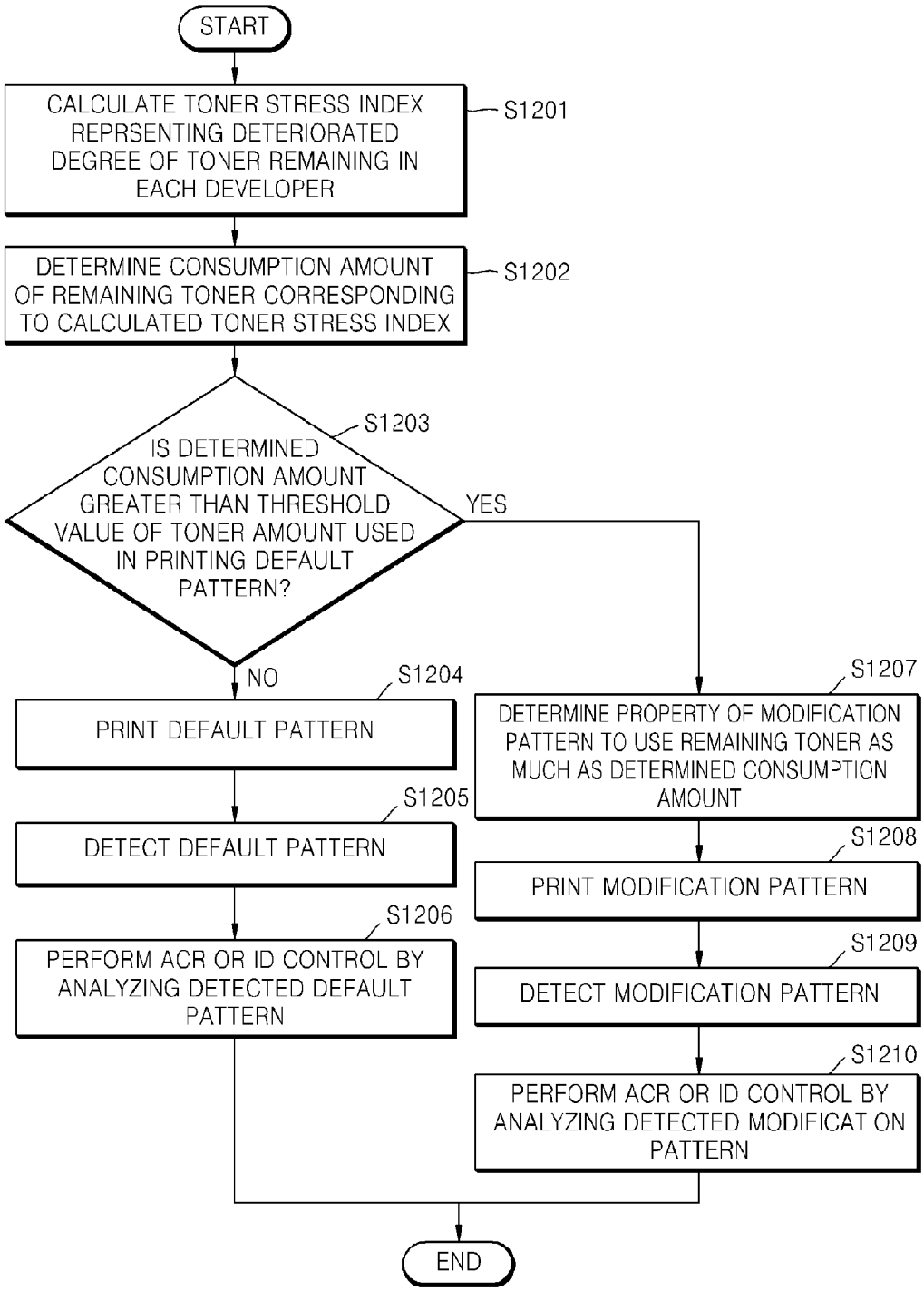
FIG. 12 is a flowchart illustrating a method of compensating for printing quality of an image in an image forming apparatus according to exemplary embodiments of the present general inventive concept.

FIG. 12 is a flowchart illustrating a method of compensating for the printing quality of an image forming apparatus, according to exemplary embodiments of the present general inventive concept. The method of compensating for the printing quality includes one or more operations which can be time-serially processed in the image forming apparatus 1 of FIG. 1. Therefore, even if it is omitted hereinafter, the descriptions of the image forming apparatus 1 of FIG. 1 may be applied to the method of compensating for the printing quality of the exemplary embodiments of the present general inventive concept.

In operation 1201, the calculator 11 can calculate TS_indexes representing the deteriorated degrees of the toners remaining in the developers.

In operation 1202, the pattern determiner 121 can determine one of the default pattern and the modification pattern according to the calculated TS_indexes. The consumption amount determiner 1211 can determine the consumption amount of the remaining toner corresponding to the calculated TS_indexes.

In operation 1203, the comparator 1212 can compare the determined consumption amount with the threshold value of the toner amount which can be used in printing the default pattern.

In operation 1204, the pattern determiner 121 can determine the pattern to be printed as the default pattern if the determined consumption amount is smaller than the threshold value. The developing unit 31, which can include a plurality of developers, in the image forming unit 30 prints the default pattern.

In operation 1205, the pattern detector 40 can detect the default pattern.

In operation 1206, the automatic color matching unit 141 and/or the automatic color compensator 142 of the compensator 14 can analyze the detected default pattern to perform the ACR and/or ID control operation.

In operation 1207, the pattern determiner 121 can determine the pattern to be printed as the modification pattern if the determined consumption amount is greater than the threshold value. The property determiner 122 can change the property of the modification pattern so as to use the remaining toner as much as the determined consumption amount.

In operation 1208, the developing unit 31, which includes a plurality of developers, in the image forming unit 30 can print the modification pattern.

In operation 1209, the pattern detector 40 can detect the modification pattern.

In operation 1210, the automatic color matching unit 141 and/or the automatic color compensator 142 of the compensator 14 can analyze the detected modification pattern to perform the ACR and/or ID control operation.

According to the above description, the pattern that may be used to compensate for the printing quality can be changed and printed according to the TS_index of the toner which is dynamically calculated, and accordingly, an appropriate amount of toner can be used and the new toner is supplied. Therefore, the TS_index of the toner may be maintained at a predetermined level, and thereby improving the printing quality. Since the changeable pattern can be used, the ACR and the ID control operations may be performed precisely. The deteriorated toner can be used to perform the ACR and the ID control operations without being discharged out of the image forming apparatus, and thus, the waiting time during the performing of the printing operation may be reduced.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can be transmitted through carrier waves or signals (e.g., wired or wireless data transmission through the Internet). Also, functional programs, codes, and code segments to accomplish the present general inventive concept can be easily construed by programmers skilled in the art to which the present general inventive concept pertains.

While the present general inventive concept has been particularly illustrated and described with reference to exemplary embodiments thereof, it will be understood by those of ordinary skill in the art that various changes in form and details may be made therein without departing from the spirit and scope of the present general inventive concept as defined by the following claims.

What is claimed is:

1. A method of compensating for printing quality of an image forming apparatus which includes a plurality of developers to print color images, the method comprising:

calculating a toner stress index representing a deteriorated degree of a toner remaining in each of the plurality of developers;

determining one of a first pattern which is a default pattern used in at least one of an auto color registration (ACR) operation and an image density (ID) control operation and a second pattern which is obtained by changing the first pattern according to the calculated toner stress index before performing the ACR operation and the ID control operation;

when the second pattern is determined, determining a property of the second pattern according to the calculated toner stress index; and printing the determined pattern with the remaining toner.

2. The method of claim 1, further comprising:

performing at least one of the ACR operation and the ID control operation with the printed pattern.

3. The method of claim 1, wherein the printing comprises:

printing the second pattern with the remaining toner after adjusting the property of the second pattern according to a consumption amount of the toner corresponding to the toner stress index.

4. The method of claim 1, wherein the calculating the toner stress index comprises:

calculating the toner stress index according to at least one of an average dot count of the image forming apparatus and the number of revolutions of a developing roller in each of the developers per one printing page.

5. The method of claim 1, wherein the determining of the pattern comprises:

determining a consumption amount of the remaining toner corresponding to the calculated toner stress index;

comparing the determined consumption amount with a threshold value of the toner amount in printing the first pattern; and determining the pattern according to the comparison result.

6. The method of claim 5, wherein the determining of the pattern determines the pattern as the first pattern when the determined consumption amount is smaller than a threshold value.

7. The method of claim 5, wherein the determining of the pattern comprises:

determining the pattern as the second pattern when the determined consumption amount is greater than the threshold value, the determining of the property comprises determining the property of the second pattern so as to use the remaining toner as much as the determined consumption amount, and the printing the pattern comprises printing the second pattern having the determined property by using a part of the remaining toner.

8. The method of claim 7, wherein when the determined consumption amount exceeds than a toner amount used to print the second pattern, the printing of the pattern further uses the part of the remaining toner as much as the exceeding amount.

9. The method of claim 1, wherein the property of the second pattern is at least one of the number of patterns, a width of the pattern in a main scanning direction, and a width of the pattern in a sub-scanning direction.

10. The method of claim 1, wherein the second pattern is obtained by increasing at least one of the number of the first patterns, a width of the first pattern in the main scanning direction, and a width of the pattern in a sub-scanning direction according to the toner stress index.

11. The method of claim 1, further comprising:

receiving a command to perform one of the ACR operation and the ID control operation, wherein the determining of the pattern determines one of the first pattern and the second pattern when the command is received by the image forming apparatus.

12. The method of claim 1, further comprising:

displaying at least one of the toner stress index, the toner consumption amount corresponding to the toner stress index, the property of the second pattern, the result of the ACR operation, and the result of the ID control operation.

13. An image forming apparatus compensating for printing quality, the image forming apparatus comprising:

a developing unit including a plurality of developers to print color images;

a calculator to calculate a toner stress index which represents a deteriorated degree of a toner remaining in each of the developers;

a pattern determiner to determine one of a first pattern which is a default pattern used in at least one of an auto color registration (ACR) operation and an image density (ID) control operation and a second pattern which is obtained by changing the first pattern according to the calculated toner stress index before performing the ACR operation and the ID control operation;

a property determiner to determine a property of the second pattern according to the calculated toner stress index when the second pattern is determined;

a storage unit to store information including the calculated toner stress index and a toner consumption amount corresponding to the toner stress index; and a controller to control the image forming apparatus to print the determined pattern with the remaining toner.

14. The image forming apparatus of claim 13, wherein the controller controls the image forming apparatus to perform one of the ACR operation and the ID control operation by using the printed pattern.

15. The image forming apparatus of claim 13, wherein the image forming apparatus prints the second pattern with the remaining toner after adjusting the property of the second pattern according to the toner consumption amount corresponding to the toner stress index.

16. The image forming apparatus of claim 13, wherein the storage unit stores information about one of an average dot count of the image forming apparatus and a number of revolutions of a developing roller for each developer, and the toner stress index is calculated according to at least one of the average dot count and the number of revolutions of the developing roller.

17. The image forming apparatus of claim 13, wherein the pattern determiner comprises:

a consumption amount determiner to determine the consumption amount of the remaining toner corresponding to the calculated toner stress index; and a comparator to compare the determined consumption amount with a threshold value of the toner amount which is used to print the first pattern to determine one of the first and second patterns according to the comparing result.

18. The image forming apparatus of claim 17, wherein the pattern determiner determines the pattern as the first pattern if the determined consumption amount is less than the threshold value.

19. The image forming apparatus of claim 17, wherein the pattern determiner determines the pattern as the second pattern when the determined consumption amount is greater than the threshold value, the property determiner determines the property of the second pattern so as to use the remaining toner as much as the determined consumption amount, and the controller controls the image forming apparatus to print the second pattern having the determined property with a part of the remaining toner.

20. The image forming apparatus of claim 13, wherein the property of the second pattern is at least one of the number of patterns, a width of the pattern in a main scanning direction, and a width of the pattern in a sub-scanning direction.

21. The image forming apparatus of claim 13, wherein the second pattern is obtained by increasing at least one of the number of the first patterns, a width of the first pattern in a main scanning direction, and a width of the pattern in a sub-scanning direction according to the toner stress index.

22. The image forming apparatus of claim 13, further comprising an input unit for receiving a command to perform one of the ACR operation and the ID control operation, wherein the pattern determiner determines one of the first and second patterns when the command is input in the image forming apparatus.

23. The image forming apparatus of claim 13, further comprising:

a display unit to display at least one of the toner stress index, the toner consumption amount corresponding to the toner stress index, the property of the second pattern, the result of the ACR operation, and the result of the ID control operation.

24. A method of compensating for printing quality of an image forming apparatus which includes a plurality of developers to print color images, the method comprising:

determining the amount of deterioration of toner in each of the plurality of developers with a processor of the image forming apparatus;

determining the consumable amount of toner remaining according to the determined amount of deterioration of the toner with the processor; and when the determined consumable amount is greater than a toner amount to print a predetermined pattern, modifying the predetermined pattern with the processor so as to use a part of the determined consumable amount of toner remaining in a print operation with the image forming apparatus.

25. The method of claim 24, further comprising:

printing the modified pattern with an image forming unit of the image forming apparatus;

detecting the printed modified pattern with a pattern detector in the image forming apparatus; and performing at least one of an auto color registration (ACR) and image density control on the detected modified pattern.

26. The method of claim 24, further comprising:

when the determined consumable amount is less than a toner amount to print a predetermined pattern, printing the predetermined pattern with the image forming apparatus.

27. The method of claim 26, further comprising:

detecting the printed modified pattern with a pattern detector in the image forming apparatus; and performing at least one of an auto color registration (ACR) and image density control on the detected modified pattern.

28. An image forming apparatus compensating for printing quality, the image forming apparatus comprising:

a plurality of developers;

a processor to determine the amount of deterioration of toner in each of a plurality of developers and to determining the consumable amount of toner remaining according to the determined amount of deterioration of the toner with the processor, wherein when the determined consumable amount is greater than a toner amount to print a predetermined pattern, the processor modifies the predetermined pattern so as to use a part of the determined consumable amount of toner remaining in a print operation with the image forming apparatus.

29. The image forming apparatus of claim 28, further comprising:

a pattern detector to detect the modified pattern that is printed by the image forming apparatus, wherein the processor performs at least one of an auto color registration (ACR) and image density control on the detected modified pattern.

30. The image forming apparatus of claim 28, wherein when the determined consumable amount is less than a toner amount to print a predetermined pattern, the predetermined pattern is printed with an image forming unit of the image forming apparatus.

31. The image forming apparatus of claim 30, further comprising:

a pattern detector to detect the printed modified pattern, wherein the processor performs at least one of an auto color registration (ACR) and image density control on the detected modified pattern.

* * * * *